US010609991B2

(12) United States Patent
Yamashita et al.

(10) Patent No.: US 10,609,991 B2
(45) Date of Patent: Apr. 7, 2020

(54) CLASP AND TIMEPIECE

(71) Applicant: Seiko Epson Corporation, Tokyo (JP)

(72) Inventors: Yuki Yamashita, Matsumoto (JP); Tomonori Momose, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/005,994

(22) Filed: Jun. 12, 2018

(65) Prior Publication Data

US 2018/0352915 A1 Dec. 13, 2018

(30) Foreign Application Priority Data

Jun. 13, 2017 (JP) ..... 2017-116230

(51) Int. Cl.
*A44C 5/24* (2006.01)

(52) U.S. Cl.
CPC ..... *A44C 5/24* (2013.01)

(58) Field of Classification Search
CPC ..... A44C 5/24
USPC ..... 24/265 WS
See application file for complete search history.

(56) References Cited

U.S. PATENT DOCUMENTS 2,532,840 A * 12/1950 Gaun ..... A44C 5/24 24/71 J
5,305,503 A * 4/1994 Yamagata ..... A44C 5/24 24/265 WS
5,313,691 A * 5/1994 Hashimoto ..... A44C 5/2042 24/265 WS
5,485,659 A * 1/1996 Kashikie ..... A44C 5/2052 24/265 WS
6,023,816 A * 2/2000 Okada ..... A44C 5/24 24/265 WS
10,085,528 B2 * 10/2018 Wong ..... A44C 5/027
2004/0038581 A1 2/2004 Brown
2004/0168469 A1 * 9/2004 Tetu ..... A44C 5/24 63/3.1
2009/0049667 A1 2/2009 Takahashi
2014/0223705 A1 * 8/2014 Catanese ..... A44C 5/24 24/71 J
2014/0352119 A1 * 12/2014 Kaltenrieder ..... A44C 5/246 24/71 J
2015/0181988 A1 * 7/2015 Kaltenrieder ..... A44C 5/24 63/3.2

FOREIGN PATENT DOCUMENTS

JP 08-308616 A 11/1996
JP 2002-325606 A 11/2002
JP 3604646 B2 12/2004
(Continued)

*Primary Examiner* — Jason W San
(74) *Attorney, Agent, or Firm* — Harness, Dickey & Pierce, P.L.C.

(57) ABSTRACT

Provided are a clasp that simplifies assembly and reduces the parts count, and a timepiece having the clasp. A first push button has a first button catch to engage a lock pin, and a second push button has a second button catch to engage the lock pin. The first and second button catches move closer together in a second direction when the first and second push buttons move in the urging direction of a first spring. The opposing faces of the first and second button catches opposite each other in the second direction are flat surfaces perpendicular to the second direction.

6 Claims, 12 Drawing Sheets

(56) References Cited

FOREIGN PATENT DOCUMENTS

| | | | |
|---|---|---|---|
| JP | 2005-270248 | A | 10/2005 |
| JP | 2009-045231 | A | 3/2009 |
| WO | WO-1996-028064 | A1 | 9/1996 |
| WO | WO-2002-074124 | A1 | 9/2002 |

* cited by examiner

CLASP AND TIMEPIECE

BACKGROUND

1. Technical Field

The present invention relates to a clasp used in a band such as a wristwatch band or a decorative accessory band, and to a timepiece having the clasp.

2. Related Art

Some clasps used in wristwatch bands or accessory bands have a mechanism for adjusting the length of the band. See, for example, Japan Patent 3604646.

The clasp in Japan Patent 3604646 has a folding member including an outside plate and an inside plate that is connected to one band and has a lock pin (engagement claw); a clasp frame connected to the outside plate; a slide plate connected to the other band and disposed to the clasp frame slidably in the lengthwise direction of the band; a push button unit attached to the clasp frame; and a push button holder that holds the push button unit. The push button unit includes a pair of push buttons, an urging member, a pair of engagement protrusions, and a removal prevention plate.

The urging member urges the pair of push buttons disposed opposite each other across in the short direction of the band away from each other.

The pair of push buttons have a pair of button catches that engage the lock pin inserted to a through-hole in the push button holder. When the pair of push buttons are moved in the urging direction by the urging member, the pair of button catches move closer together in the short direction of the band.

The pair of engagement protrusions engage the slide plate and restrict the slide plate from sliding, and are configured to disengage the slide plate when the pair of push buttons move opposite the urging direction of the urging member. Because this configuration disengages the pair of engagement protrusions from the slide plate when the pair of push buttons are pressed, the slide plate slide relative to the clasp frame when thus disengaged, and the band length can be adjusted.

In this operation installing the push button unit to the push button holder, the pair of push buttons, the urging member, and the pair of engagement protrusions are supported by the removal prevention plate when installed in the push button holder.

However, reducing the parts count in order to reduce cost is desirable for a timepiece component, for example. As a result, eliminating the removal prevention plate from the component parts of the push button unit by enabling the push button holder to hold the push button unit without using the engagement protrusions is desirable.

However, if the push button holder holds the pair of push buttons, the urging member, and the pair of engagement protrusions directly without using the removal prevention plate in the clasp taught in Japan Patent No. 3604646, the parts may come apart during assembly, and the clasp cannot be easily assembled.

More specifically, the removal prevention plate restricts the pair of push buttons from moving in the urging direction of the urging member. As a result, if the removal prevention plate is not present, the pair of push buttons may move in the urging direction, and the pair of button catches move closer together in the short direction of the band and touch.

In the clasp in Japan Patent No. 3604646, the ends of the pair of button catches opposing each other in the short direction of the band are indented in an arc when seen from the face side. As a result, if the pair of button catches move closer together in the short direction of the band and touch, the end of one button catch may move along the arc of the end of the other button catch, causing the push buttons to move apart in the lengthwise direction. As a result, the parts may come apart.

SUMMARY

An objective of the present invention is to provide a clasp that simplifies assembly and reduces the parts count, and a timepiece.

The invention is a clasp connecting a first band and a second band, and including: folding member including an outside plate, and an inside plate connected to the first band and having a lock pin; a clasp frame connected to the outside plate; a slide plate connected to the second band, and disposed slidably in a first direction to the clasp frame; a first push button and a second push button installed to the clasp frame, and disposed in a second direction perpendicular to the first direction as seen from the face side; a first spring configured to urge the first and second push buttons away from each other in the second direction; a first latch member and a second latch member configured to engage the slide plate and restrict the slide plate from sliding, and disengage the slide plate when the first and second push buttons move in the opposite direction as the urging direction of the first spring; and a push button holder configured to hold the first and second push buttons, the first spring, and the first and second latch members, and having a through-hole to which the lock pin inserts. The first push button has a first button catch configured to engage the lock pin inserted to the through-hole. The second push button has a second button catch configured to engage the lock pin inserted to the through-hole. The first and second button catches move closer together in the second direction when the first and second push buttons move in the urging direction of the first spring. The opposing faces of the first and second button catches opposite each other in the second direction are flat surfaces perpendicular to the second direction.

In the invention, the opposing faces of the first and second button catches opposite each other in the second direction are flat surfaces perpendicular to the second direction.

This configuration can help prevent parts from coming apart during assembly of the clasp even if the first and second push buttons move in the urging direction when placing the assembled first and second push buttons, first spring, and first and second latch members in the push button holder.

More specifically, for example, if the opposing faces of the first and second push buttons curve in an arc as seen from the face side, the first and second push buttons move in the urging direction, and the opposing faces of the first and second button catches move closer together in the second direction and touch, one of the button catches will move along the curved opposing face of the other button catch, and the first and second push buttons can shift in the first direction.

However, because the opposing faces of the first and second button catches in the invention are flat surfaces perpendicular to the second direction, when the opposing faces of the first and second button catches move closer together in the second direction and touch, applying force to the first and second push buttons in a direction intersecting the second direction can be suppressed. As a result, shifting of the first and second push buttons in a direction intersecting the second direction can be suppressed, and parts can be prevented from falling apart. As a result, the parts can be held easily in the push button holder without using a removal prevention plate configured to restrict the first and second push buttons from moving in the urging direction.

Preferably in a clasp according to another aspect of the invention, the first push button has a first button body of which part protrudes from the clasp frame in the second direction, a first button arm protruding from the first button body in the opposite direction as the second direction, and a first button catch protruding from the first button arm in the first direction; the second push button has a second button body of which part protrudes from the clasp frame in the second direction, a second button arm protruding from the second button body in the second direction, and a second button catch protruding from the second button arm in the opposite direction as the first direction, and opposing the first button catch in the second direction; the first button catch is positioned in the second direction between the second button body and the second button catch, and the first button catch contacts the second button arm; and the second button catch is positioned in the second direction between the first button body and the first button catch, and the second button catch contacts the first button arm.

In this embodiment of the invention, when the first and second push buttons are moved in the urging direction by the first spring, the first button catch moves in the direction approaching the second button catch with the distal end in contact with the second button arm, and the second button catch moves in the direction approaching the first button catch with the distal end in contact with the first button arm. As a result, when the first and second push buttons are assembled and installed to the push button holder, the first and second push buttons can move easily in the second direction, and shifting of the first and second push buttons in the direction intersecting the second direction can be suppressed.

Preferably in a clasp according to another aspect of the invention, the first and second button catches are shorter than the first and second button bodies in a thickness direction from a back surface to a face surface.

Compared with a configuration in which the first and second button catches have the same dimension as the first and second button bodies in the thickness direction, when the lock pin is engaged by the first and second button catches, the combined dimension in the thickness direction of the first and second button catches and the lock pin can be shortened. As a result, a thin clasp can be made.

Note that the area of the opposing faces of the first and second button catches is smaller in this configuration than in a configuration in which the first and second button catches have the same dimension in the thickness direction as the first and second button bodies. As a result, when the opposing faces are touching and force in a direction intersecting the second direction is applied to the first and second push buttons, the first and second push buttons can more easily shift in the direction intersecting the second direction. However, because the opposing faces in the invention are flat surfaces perpendicular to the second direction, applying force in a direction intersecting the second direction to the first and second push buttons when the opposing faces are touching can be suppressed. As a result, the first and second push buttons shifting in a direction intersecting the second direction can be suppressed.

Preferably in a clasp according to another aspect of the invention, the lock pin inserted to the through-hole passes between the opposing faces of the first and second button catches, and engages a face side of the first and second button catches; and the first and second button catches have a beveled or curved surface continuing from an outside edge on a back side of the opposing face, and extending in a direction away from the lock pin.

Compared with a configuration in which the first and second button catches are not beveled or curved, this configuration can more easily guide the lock pin inserted to the through-hole to the opposing faces, and more easily engage the surfaces of the first and second button catches. As a result, putting on the band on the user's wrist and taking the band off is easier.

A clasp according to another aspect of the invention preferably also has a second spring urging the first and second latch members away from each other in the second direction; the slide plate is disposed to a face side of the first and second push buttons; the first and second latch members protrude from the first and second push buttons to the face side; and the second spring is located closer to the face side than the first spring.

Because the first and second latch members in this aspect of the invention protrude to the face side from the first and second push buttons, the first and second latch members and the slide plate disposed on the face side of the first and second push buttons can be reliably engaged.

Furthermore, because the second spring is disposed closer to the face side than the first spring, the first and second latch members can be urged to a position closer to the center of the thickness direction between the back and the face side than when the second spring is disposed at the same height as the first spring. As a result, the first and second latch members can be urged without tilting.

Note that compared with a configuration in which the second spring is disposed at the same height as the first spring, this configuration makes applying force to the first and second push buttons in a direction intersecting the second direction easier. However, because the opposing faces of the first and second button catches in the invention are flat surfaces perpendicular to the second direction, applying force in a direction intersecting the second direction to the first and second push buttons when the opposing faces are touching can be suppressed. As a result, the first and second push buttons shifting in a direction intersecting the second direction can be suppressed.

Another aspect of the invention is a timepiece having the clasp described above.

This aspect of the invention simplifies timepiece assembly.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Figure 1:
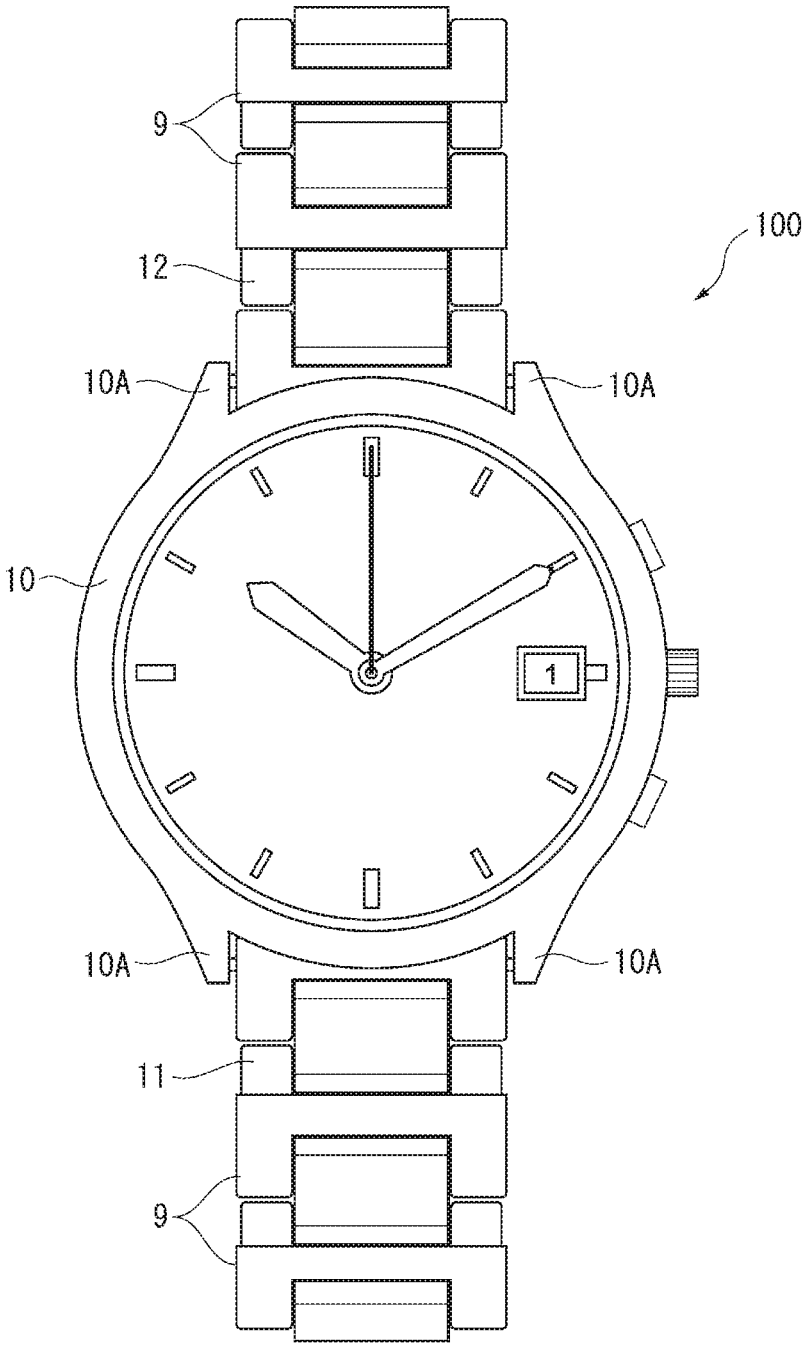
FIG. 1 is a plan view from the dial side of a timepiece according to the invention.

As shown in FIG. 1, a wristwatch 100 described below as an example of a timepiece according to the invention has an external case 10, a band 11 (first band), and another band 12 (second band). A pair of lugs 10A is formed integrally to the external case 10 at both 6:00 and 12:00. The first band 11 is connected to the lugs 10A at 6:00 using a spring bar, and the second band 12 is connected to the lugs 10A at 12:00 using a spring bar.

The bands 11 and 12 comprise multiple links 9 connected by pins not shown.

The open ends of the bands 11 and 12 are connected by the clasp 1 shown in FIG. 2 to FIG. 5.

Figure 2:
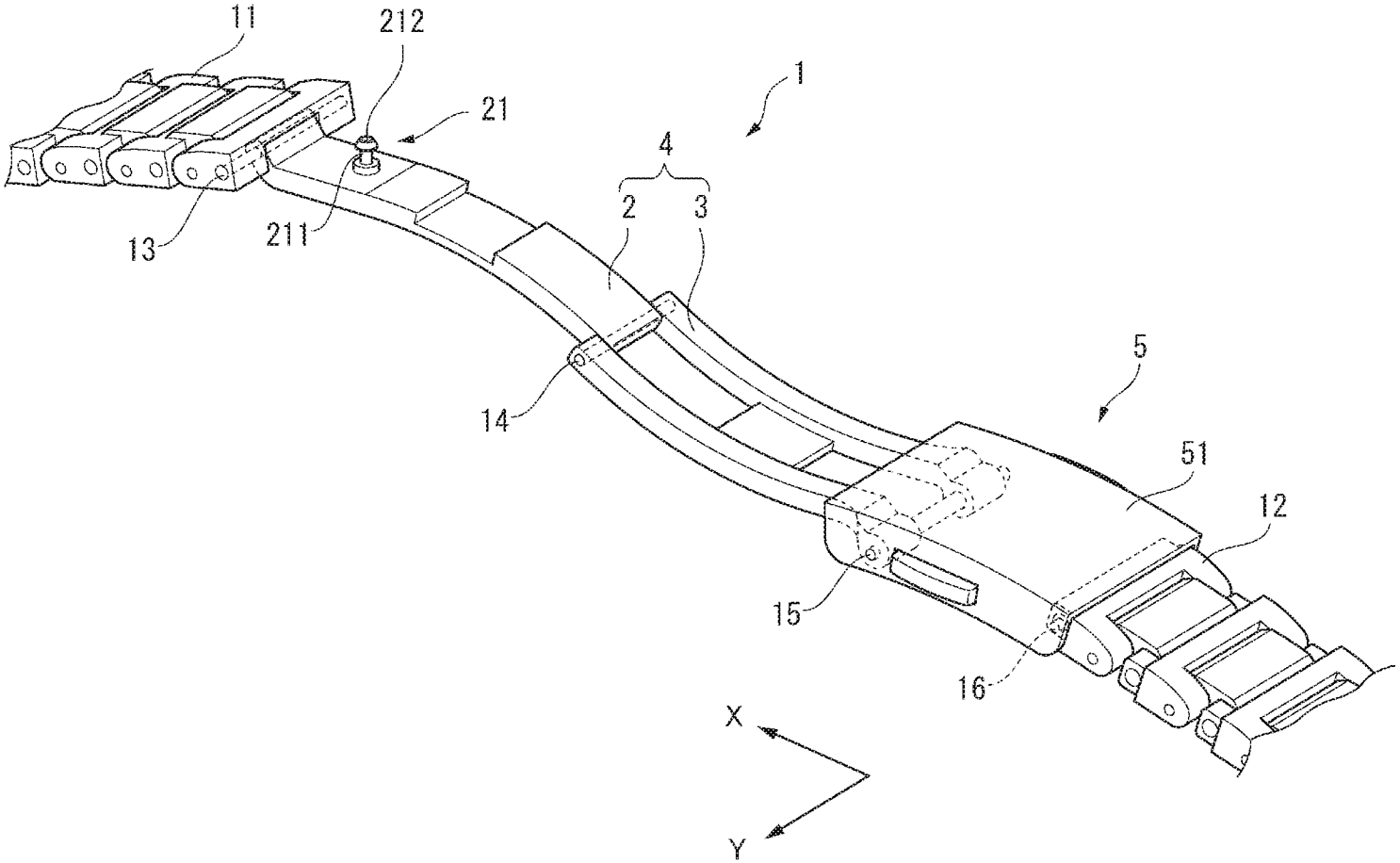
FIG. 2 is an oblique view of the clasp according to a preferred embodiment of the invention with the folding member open.
Figure 3:
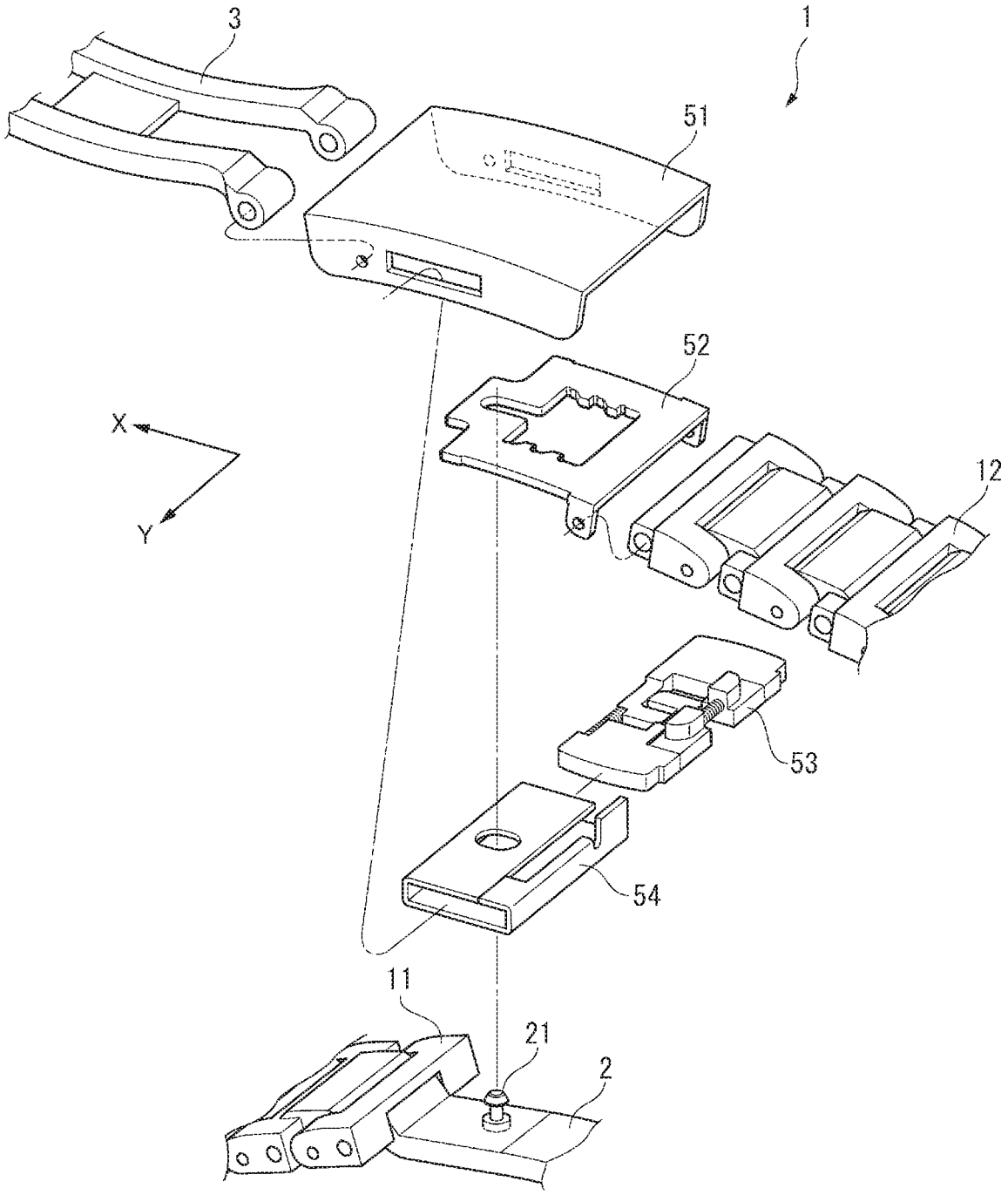
FIG. 3 is an oblique view of part of the clasp according to a preferred embodiment of the invention.
Figure 4:
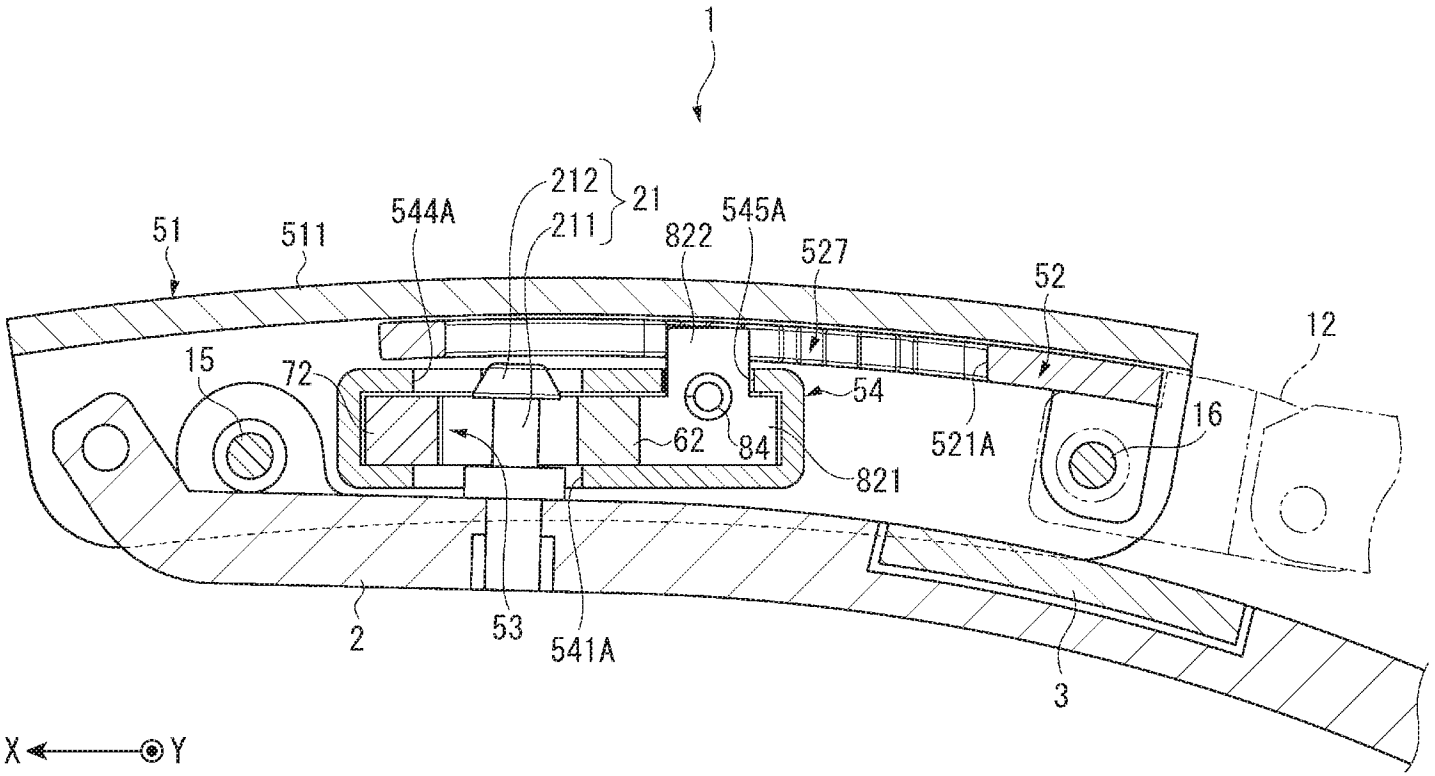
FIG. 4 is a section view if the clasp when the folding member according to a preferred embodiment of the invention is folded closed.
Figure 5:
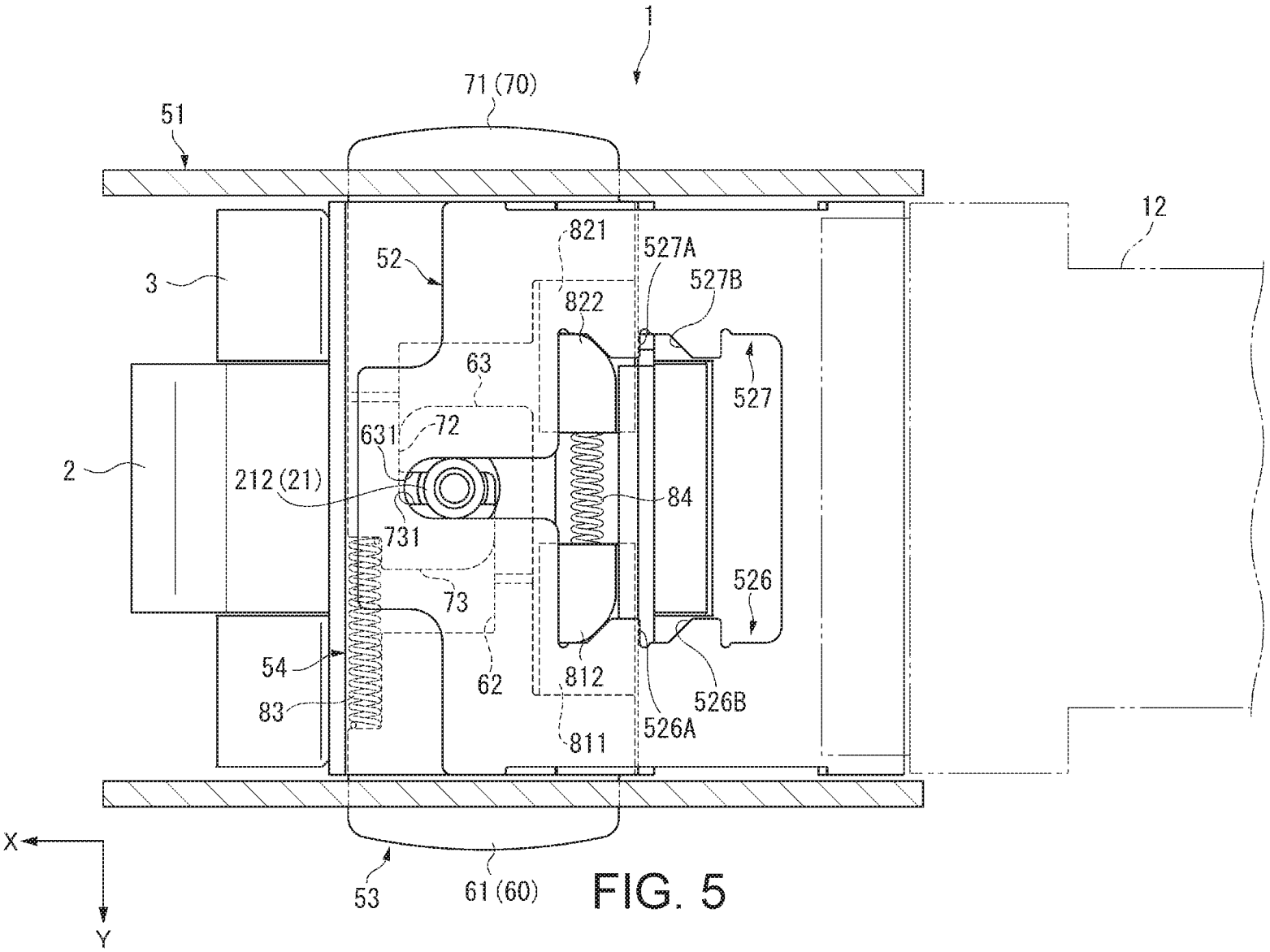
FIG. 5 is a plan view of the clasp according to a preferred embodiment of the invention showing the folding member folded closed.

FIG. 2 is an oblique view of the clasp 1 when the folding member 4 is open. FIG. 3 is an oblique view of part of the clasp 1. FIG. 4 is a section view, from the short direction of the band, of the clasp 1 when the folding member 4 is folded closed. FIG. 5 is a plan view of the clasp 1 from the face side when the folding member 4 is folded closed. Note that the face part 511 of the clasp frame 51 is not shown in FIG. 5.

Figure 6:
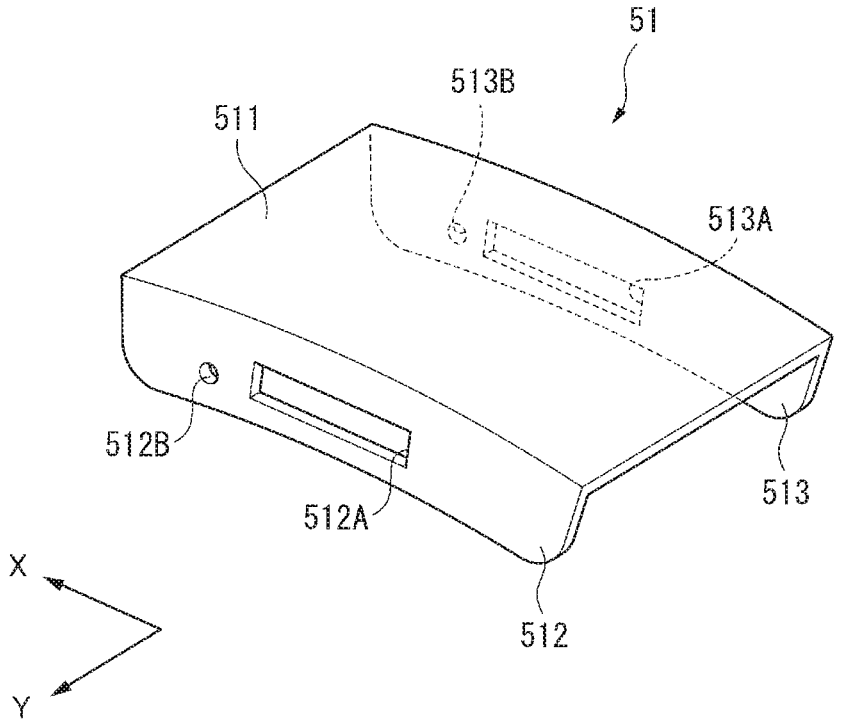
FIG. 6 is an oblique view of the clasp frame according to a preferred embodiment of the invention.
Figure 7:
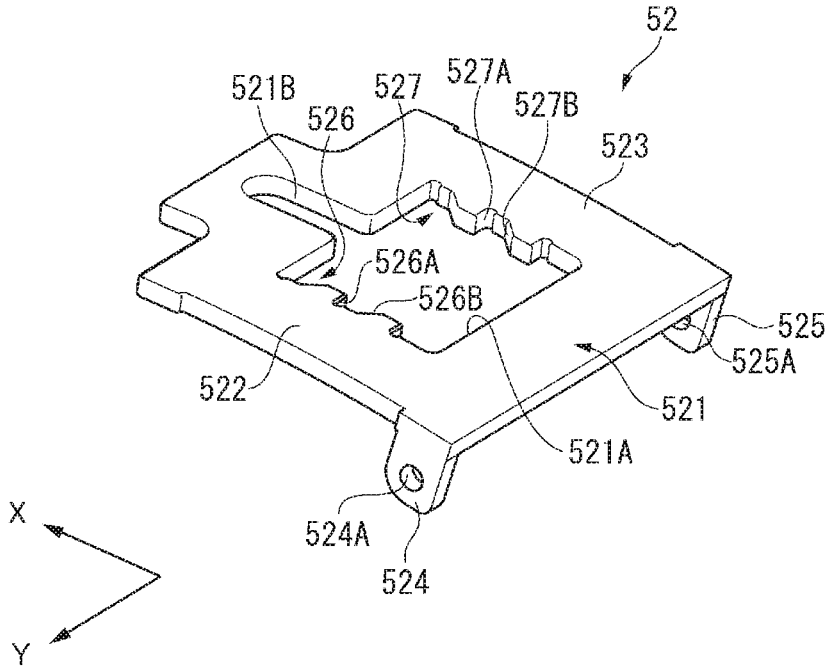
FIG. 7 is an oblique view of the slide plate according to a preferred embodiment of the invention.
Figure 8:
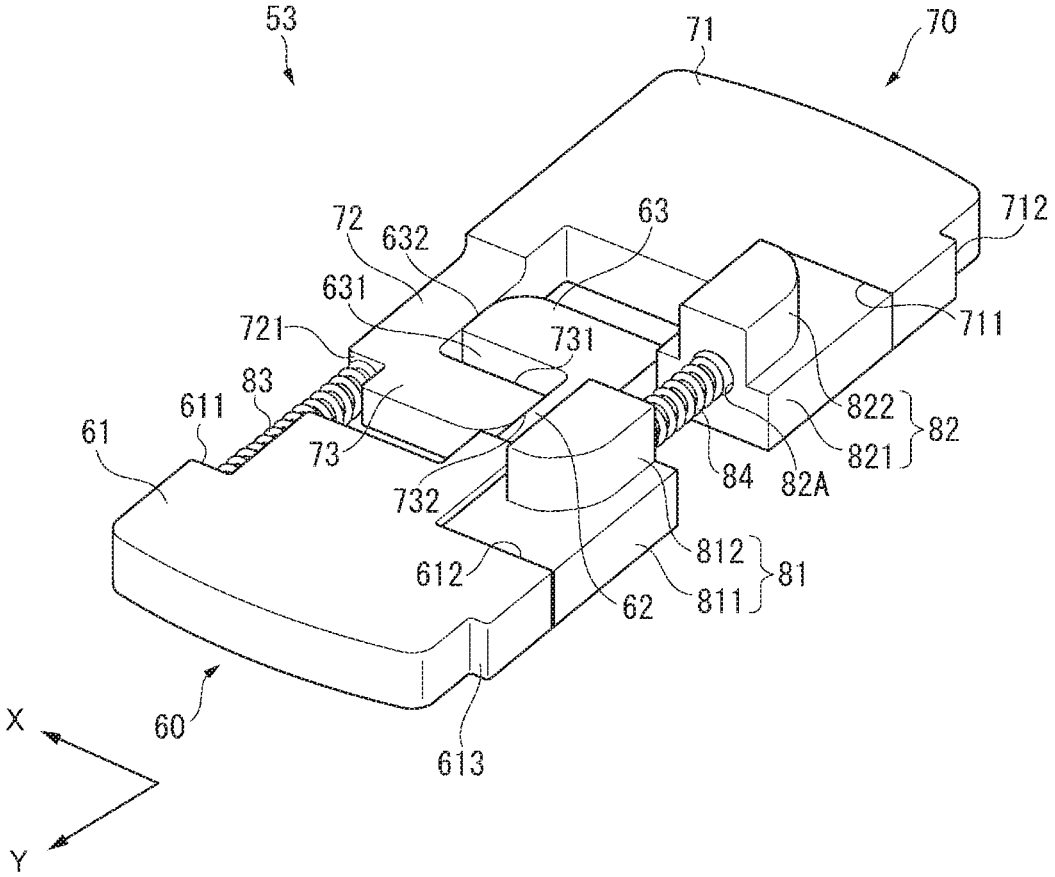
FIG. 8 is an oblique view of the push button unit according to a preferred embodiment of the invention.
Figure 9:
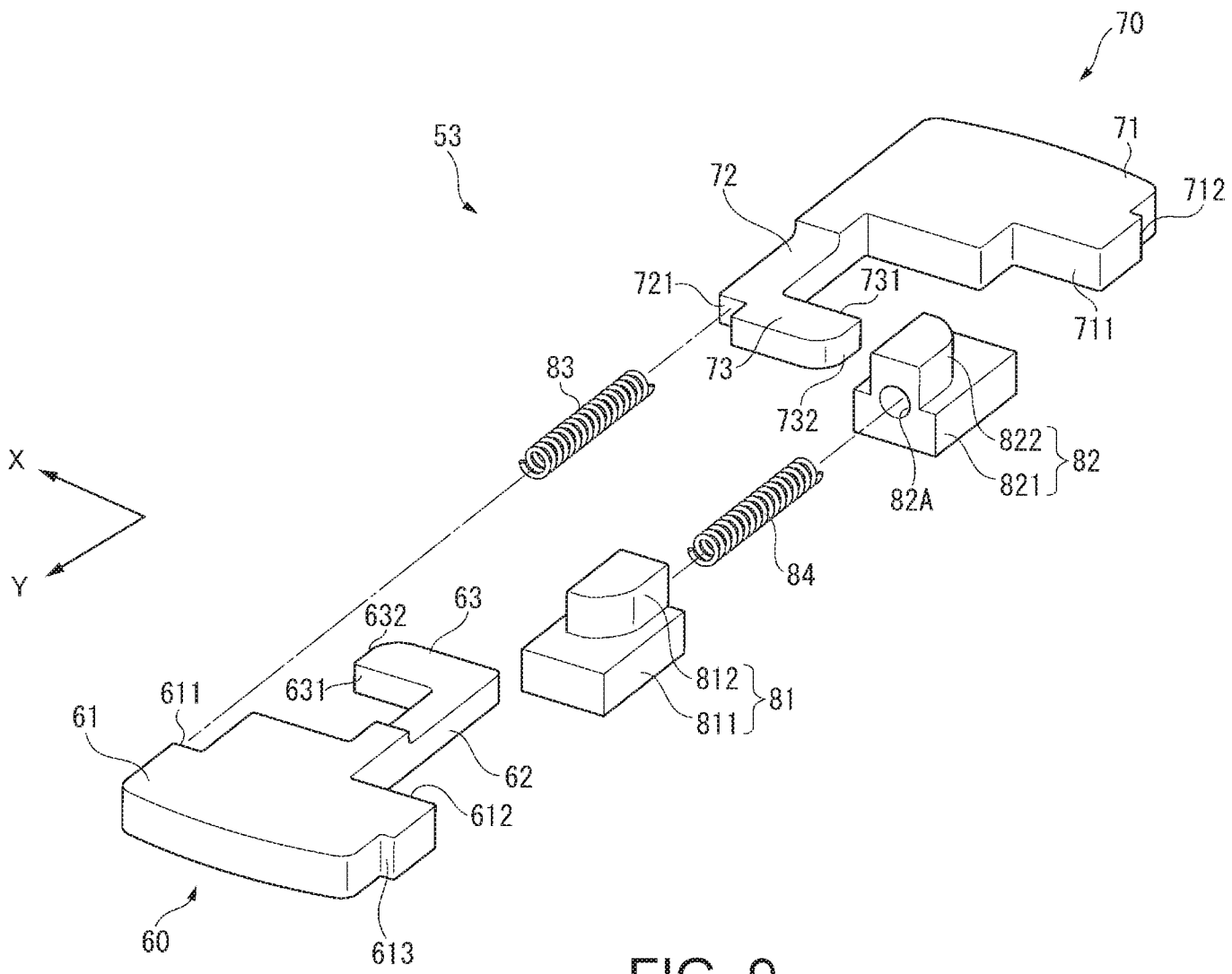
FIG. 9 is an oblique view of part of the push button unit according to a preferred embodiment of the invention.
Figure 10:
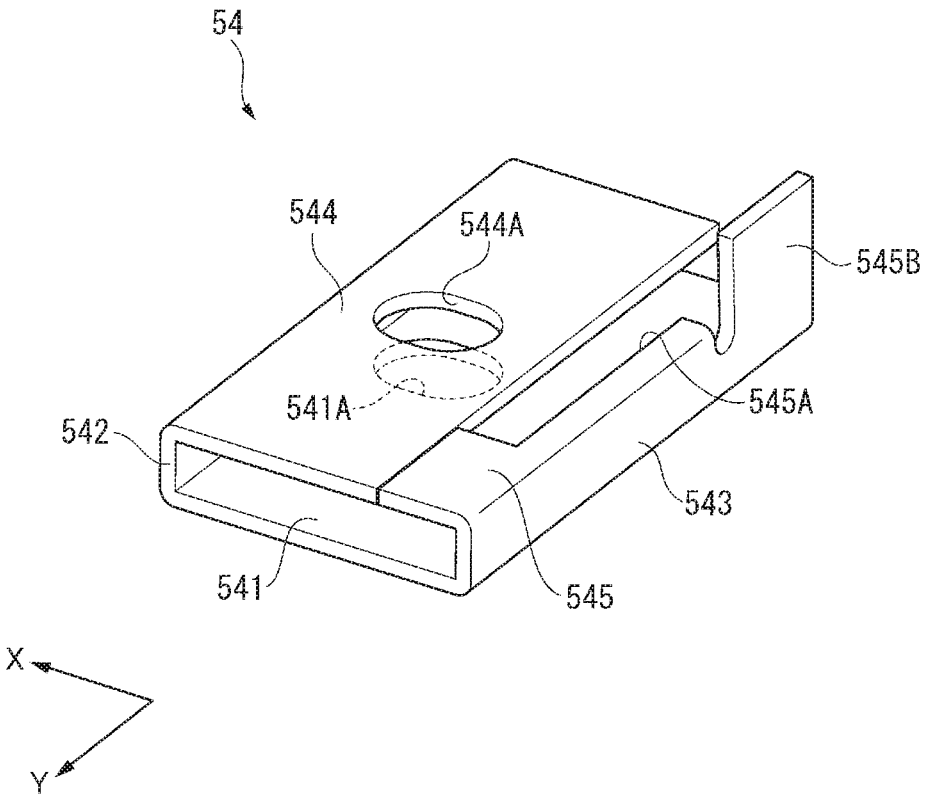
FIG. 10 is an oblique view of the push button holder according to a preferred embodiment of the invention.

FIG. 6 is an oblique view of the clasp frame 51; FIG. 7 is an oblique view of the slide plate 52; FIG. 8 is an oblique view of the push button unit 53; FIG. 9 is an oblique view of part of the push button unit 53; and FIG. 10 is an oblique view of the push button holder 54.

The clasp 1, as shown in FIG. 2, includes a folding member 4, and a clasp pusher 5.

Folding Member Configuration

The folding member 4 includes an inside plate 2 and an outside plate 3.

One end of the inside plate 2 is pivotably connected to the first band 11 by a connector pin 13. The other end of the inside plate 2 is pivotably connected to one end of the outside plate 3 by another connector pin 14.

A lock pin 21 that protrudes toward the face side is disposed to the inside plate 2. The lock pin 21 has a shank 211 protruding from the inside plate 2, and a head 212 disposed to the distal end of the shank 211.

The other end of the outside plate 3 is pivotably connected to the clasp frame 51 of the clasp pusher 5 by a connector pin 15.

Clasp Pusher Configuration

The clasp pusher 5, as shown in FIG. 3 to FIG. 5, includes the clasp frame 51, the slide plate 52 disposed inside the clasp frame 51, the push button unit 53, and the push button holder 54.

Clasp Frame Configuration

The clasp frame 51, as shown in FIG. 6, includes a face member 511 that curves in an arc on the sliding direction (X direction and −X direction) of the slide plate 52; and side walls 512 and 513 that project to the back side from the outside edges of the face member 511 in the direction perpendicular (Y direction and −Y direction) to the sliding direction as seen from the face side of the face member 511. Note that the axis of the X direction and −X direction is also referred to herein as the X axis or a first direction, and the axis of the Y direction and −Y direction is also referred to herein as the Y axis or a second direction.

Disposed in the side walls 512 and 513 are through-holes 512A and 513A in which part of the button body 61 and 71 of the push buttons 60 and 70 described below are inserted as described below, and holes 512B and 513B which the connector pin 15 (see FIG. 2) engages.

Slide Plate Configuration

The slide plate 52, as shown in FIG. 4, is disposed slidably on the X axis on the back side of the face member 511 of the clasp frame 51. The slide plate 52, as shown in FIG. 7, has a plate 521, an arm 524 extending to the back from part of the outside edge of the plate 521 on the Y direction side, and an arm 525 extending to the back from part of the outside edge of the plate 521 on the −Y direction side.

Disposed to the arms 524 and 525 are through-holes 524A and 525A engaged by a connector pin 16 (see FIG. 2) used to connect to the second band 12 (see FIG. 2).

The plate 521 has an opening 521A. Notches 526, 527 are disposed on the opening 521A side edges 522, 523 of the plate 521 on opposite sides of the opening 521A on the Y direction. Notch 526 and notch 527 are disposed opposite each other on the Y direction with three of each along the X direction.

As shown in FIG. 5, a protruding engaging part 812 (described below) of the push button unit 53 engages one of the notches 526, and another protruding engaging part 822 engages one of the notches 527.

As shown in FIG. 5 and FIG. 7, the inside surfaces 526A, 527A on the X direction side of the notches 526, 527 are extended in the Y direction. Of the notches 526, 527, the inside surfaces 526B, 527B on the −X direction side of the two notches 526, 527 from the X direction side are formed sloping to the −X direction side as seen from the face side. The inside surfaces 526B, 527B on the −X direction side of the third notches 526, 527 from the X direction side extend in the Y direction.

While described more specifically below, by forming the notches 526, 527 in this way, the slide plate 52 can slide in the X direction without pushing the push buttons 60 and 70.

The plate 521 also has a slot 521B formed in the X direction on the X direction side of the opening 521A. As shown in FIG. 5 from the face side, the head 212 of the lock pin 21 is disposed to the slot 521B.

Pushbutton Unit Configuration

The push button unit 53, as shown in FIG. 4, is disposed on the back side of the slide plate 52, and as shown in FIG. 8 and FIG. 9, includes push buttons 60 and 70 disposed on the Y axis, latch members 81 and 82, and springs 83 and 84, which in this example are coil springs.

The push buttons 60 and 70 are configured so they can be pushed together in the Y direction.

More specifically, push button 60 (first push button) includes a button body 61 (first button body) of which part is inserted to through-hole 512A in the clasp frame 51 and protrudes outside from the clasp frame 51; a button arm 62 (first button arm) extending in the −Y direction from the button body 61; and a button catch 63 (first button catch) that protrudes in the X direction from the distal end of the button arm 62, and engages the lock pin 21 as shown in FIG. 5.

As shown in FIG. 8, the button catch 63 is positioned on the Y direction between the button body 71 described below and the button catch 73 described below. The distal end 632 of the button catch 63 contacts the button arm 72 described below. As shown in FIG. 8 and FIG. 9, the button catch 63 is formed so that the dimension in the thickness direction from the back to the face side is shorter than button body 61.

On the −Y direction end of the button body 61 are disposed a receiver 611 that receives the spring 83, and a receiver 612 that receives the latch member 81. On the Y direction end of the button body 61 is disposed a contact 613 that contacts the side wall 512 of the clasp frame 51.

As shown in FIG. 8 and FIG. 9, push button 70 (second push button) includes a button body 71 (second button body) of which part is inserted to through-hole 513A in the clasp frame 51 and protrudes outside from the clasp frame 51; a button arm 72 (second button arm) extending in the Y direction from the button body 71; and a button catch 73 (second button catch) that protrudes in the −X direction from the distal end of the button arm 72, and engages the lock pin 21 as shown in FIG. 5.

As shown in FIG. 8, the button catch 73 is positioned on the Y direction between the button body 61 and the button catch 63. In other words, button catch 63 and button catch 73 are disposed opposite each other on the Y direction. The distal end 732 of the button catch 73 contacts the button arm 62. As shown in FIG. 8 and FIG. 9, the button catch 73 is formed so that the dimension in the thickness direction from the back to the face side is shorter than button body 71.

On the Y direction end of the button body 71 at a position opposite the receiver 612 of the pushbutton 60 is disposed a receiver 711 that receives the spring latch member 82. On the −Y direction end of the button body 71 is disposed a contact 712 that contacts the side wall 513 of the clasp frame 51. At the distal end of the button arm 72 at a position opposite the receiver 611 of the push button 60 is disposed a receiver 721 that receives a spring 83.

In this embodiment, as shown in FIG. 5, FIG. 8, and FIG. 9, the opposing faces 631, 731 facing each other in the Y direction of the button catches 63, 73 are flat surfaces perpendicular to the Y direction. More specifically, the opposing faces 631, 731 are flat surfaces in the X direction and the thickness direction.

As shown in FIG. 8 and FIG. 9, latch member 81 (first latch member) has a base part 811 that is received by the receiver 612 of the push button 60; and an engaging part 812 that protrudes from the base part 811 to the face side, and as shown in FIG. 5, engages a notch 526 in the slide plate 52. More specifically, the latch member 81 protrudes from the push buttons 60 and 70 to the face side.

Disposed to the −Y direction end of the latch member 81 is a hole (not shown in the figure) that receives the spring 84. When seen from the face side, the −X direction side of the Y direction end of the engaging part 812 is formed with a curve.

As shown in FIG. 8 and FIG. 9, latch member 82 (second latch member) has a base part 821 that is received by the receiver 711 of the push button 70; and an engaging part 822 that protrudes from the base part 821 to the face side, and as shown in FIG. 5, engages a notch 527 in the slide plate 52. More specifically, the latch member 82 protrudes from the push buttons 60 and 70 to the face side.

Disposed to the Y direction end of the latch member 82 is a hole 82A that receives the spring 84. When seen from the face side, the −X direction side of the −Y direction end of the engaging part 822 is formed with a curve.

The spring 83 is held between the receiver 611 of the button body 61, and the receiver 721 of the button arm 72.

The spring 84 (second spring) is held between latch members 81 and 82.

Spring 84 is disposed closer to the face side than spring 83. Compared with a configuration in which the spring 84 is disposed at the same height as the other spring 83, this configuration can urge the latch members 81 and 82 to a position near the center of the thickness direction. As a result, the latch members 81 and 82 can be urged without tilting.

With the push button unit 53 thus comprised, the latch members 81 and 82 are urged in the direction away from each other on the Y axis by spring 84. The push buttons 60 and 70 are urged by spring 83, and by the latch members 81 and 82 urged by spring 84, in the direction away from each other on the Y axis.

When the push buttons 60 and 70 move in the direction urged by springs 83 and 84, the button catches 63, 73 move closer together on the Y axis.

When the button bodies 61 and 71 are pushed by the user, and the push buttons 60 and 70 move in the opposite direction as the urging direction of the springs 83 and 84, the button catches 63, 73 move away from each other on the Y axis.

Pushbutton Holder

The push button holder 54, as shown in FIG. 10, is a tubular member with openings on the Y direction and −Y direction, and has a bottom 541, sides 542 and 543, and top members 544 and 545.

The bottom 541 is rectangular, and has an insertion hole 541A in which the lock pin 21 is inserted.

The one side 542 is formed extending to the face side from the X direction edge of the bottom 541.

The top member 544 extends in the −X direction from the distal end of the side 542. As shown in FIG. 4, a hole 544A in which the head 212 of the lock pin 21 is placed is disposed to the top member 544.

The other side 543 is formed extending to the face side from the −X direction edge of the bottom 541.

The top member 545 extends in the X direction from the distal end of the side 543. The distal end in the direction of the extension of the top member 545 is opposite the distal end of the extension of the top member 544. In addition, a slot 545A extending in the Y direction is disposed to the top member 545. Note that in FIG. 10 the face part 545B of the top member 545 on the −Y direction end of the slot 545A shows the face part 545B being bent. While described further below, after the push button unit 53 is inserted to the push button holder 54, the face part 545B is bent in the X direction to a position opposite the distal end of the other top member 544.

Figure 11:
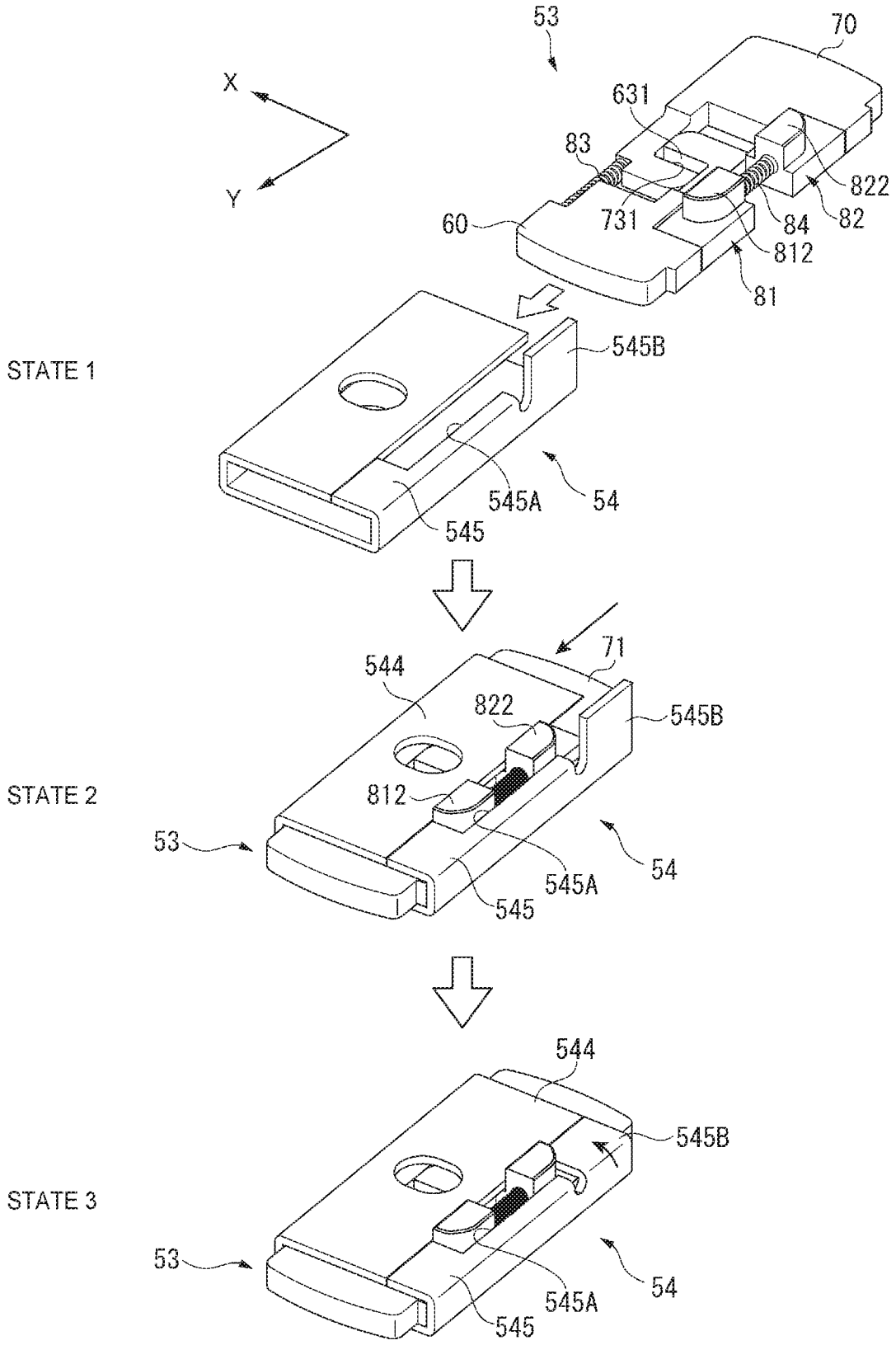
FIG. 11 illustrates a method of causing the push button unit according to a preferred embodiment of the invention to hold the push button holder.

As shown in FIG. 4 and state 3 in FIG. 11, the push button unit 53 is housed and held in the space enclosed by the bottom 541, sides 542 and 543, and top members 544 and 545. The engaging parts 812 and 822 of the latch members 81 and 82 pass through the slot 545A in the top member 545, and protrude to the face side of the pushbutton holder 54.

Thus comprised, the pushbuttons 60 and 70 can be prevented from shifting in the X direction by the sides 542 and 543 of the push button holder 54. In addition, the push buttons 60 and 70 can be prevented from shifting in the thickness direction by the bottom 541 and the top members 544 and 545 of the push button holder 54. As a result, the push buttons 60 and 70 can only move on the Y axis.

Installing the Push Button Unit to the Push Button Holder

A method of installing the push button unit 53 to the push button holder 54 is described next.

First, as shown in state 1 in FIG. 11, after assembling the parts of the push button unit 53, the push button unit 53 is slid into the push button holder 54 from the −Y side opening.

At this time, the face part 545B on the −Y direction end of the slot 545A in the top member 545 of the push button holder 54 is upright, extending towards the face side. As a result, the engaging parts 812 and 822 can be guided into the slot 545A.

Next, as shown in state 2 in FIG. 11, the button body 71 is pushed by a tool, for example, so that the one engaging part 822 moves toward the other engaging part 812 until the engaging part 822 does not interfere with the face part 545B, and the face part 545B is then bent in the X direction until the distal end of the face part 545B is opposite (beside) the distal end of the top member 544, as shown in state 3 in FIG. 11. As a result, the push button unit 53 is held inside the push button holder 54.

Note that instead of pushing the button body 71, the engaging part 822 may be pushed toward the engaging part 812 using a tool that engages the engaging parts 812 and 822 and holds the distance between the engaging parts 812 and 822 on the Y axis at a specific distance.

Further alternatively, the engaging part 822 may be pushed toward the engaging part 812 by, for example, inserting a pin through the insertion hole 541A and hole 544A in the push button holder 54 to keep the distance between the button catches 63, 73 from going to or below a specific distance.

Note that in this embodiment, as described above, the opposing faces 631, 731 of the button catches 63, 73 are flat faces perpendicular to the Y direction. As a result, when the push button unit 53 is held in the push button holder 54, the push buttons 60 and 70 can move in the direction urged by the springs 83 and 84, and when the button catches 63, 73 move together and touch on the Y axis, application of a force acting on the push buttons 60 and 70 in the direction intersecting the Y axis can be suppressed. Shifting of the push buttons 60 and 70 in a direction intersecting the Y axis can therefore be suppressed, and the parts separating and falling apart can be suppressed.

Putting on and Taking Off a Wristwatch

A method of attaching the wristwatch 100 to the user's wrist is described next.

First, the user passes a wrist through the bands 11 and 12, and folds the outside plate 3 to the inside plate 2. As a result, as shown in FIG. 4 and FIG. 5, the lock pin 21 of the inside plate 2 is inserted between the insertion hole 541A of the push button holder 54 and the opposing faces 631, 731 of the button catches 63, 73.

As a result, the push buttons 60 and 70 move in the urging direction of the springs 83 and 84, the button catches 63, 73 move closer together, the opposing faces 631, 731 of the button catches 63, 73 contact the shank 211 of the lock pin 21, and the head 212 of the lock pin 21 engages the surface of the button catches 63, 73. The wristwatch 100 is thus attached to the wrist.

Removing the wristwatch 100 from the wrist is described next.

To remove the wristwatch 100, the user pushes the button bodies 61 and 71, causing the button catches 63, 73 to move apart from each other, and then opens the inside plate 2 and outside plate 3. As a result, the head 212 of the lock pin 21 passes between the opposing faces 631, 731 of the button catches 63, 73, and slips out from the insertion hole 541A of the push button holder 54. The wristwatch 100 can thus be removed from the wrist.

Adjusting the Band Length

A method of adjusting the length of the band is described next.

First, the user pushes the button bodies 61 and 71 so that the engaging parts 812 and 822 move together, thereby disengaging engagement of the engaging parts 812 and 822 with the notches 526, 527.

By then moving the second band 12 from this position in the X direction or the −X direction, the slide plate 52 can be moved relative to the clasp frame 51 in the X direction or the −X direction.

Pressure on the button bodies 61 and 71 is then released, moving the engaging parts 812 and 822 away from each other and engaging different notches 526, 527 from the notches 526, 527 that were previously engaged. The length of the band can thus be adjusted.

In this embodiment, as described above, of the notches 526, 527 disposed to the slide plate 52, the inside surfaces 526B, 527B of the two notches 526, 527 on the X direction side are formed sloping to the −X direction side as seen from the face side. In addition, the −X direction side of the Y direction end of the engaging part 812, and the −X direction side of the −Y direction end of the engaging part 822, are formed with a curve when seen from the face side. The latch members 81 and 82 are separate from the push buttons 60 and 70.

Thus comprised, when the engaging parts 812 and 822 are engaged with the first or second notches 526, 527 from the X direction side, the engaging parts 812 and 822 can be moved along the inside surfaces 526B, 527B and engaged with the adjacent notches 526, 527 on the −X direction side by simply pushing the slide plate 52 in the X direction without pushing the button bodies 61 and 71. The band length can therefore be shortened without pushing the button bodies 61 and 71.

Note that when the button bodies 61 and 71 are pushed in this embodiment of the invention, the distance between the opposing faces 631, 731 of the button catches 63, 73 first opens sufficiently for the lock pin 21 to pass, and by pushing the button bodies 61 and 71 further, engagement of the engaging parts 812 and 822 and the notches 526, 527 is released.

By pushing the button bodies 61 and 71 until the gap between the opposing faces 631, 731 expands to allow the lock pin 21 to pass through, and then holding this position while putting the wristwatch 100 on the wrist or taking it off, this configuration can prevent releasing engagement of the engaging parts 812 and 822 and the notches 526, 527. As a result, changing the band length unintentionally can be prevented.

Operating Effect

In this embodiment of the invention, the opposing faces 631, 731 of the button catches 63, 73 are flat surfaces perpendicular to the Y direction. As a result, when the push buttons 60 and 70 move in the urging direction of the springs 83 and 84, and the button catches 63, 73 move together in the Y direction and contact while installing the push button unit 53 to the push button holder 54, shifting of the push buttons 60 and 70 in the direction intersecting the Y direction can be suppressed, and the parts falling apart can be suppressed. As a result, the parts can be easily held in the push button holder 54 without using a removal prevention plate configured to restrict the push buttons 60 and 70 from moving in the urging direction.

In this embodiment of the invention, when the push buttons 60 and 70 move in the urging direction, the button catch 63 moves in the direction approaching the button catch 73 while the distal end 632 is in contact with the button arm 72, and the button catch 73 moves in the direction approaching the button catch 63 while the distal end 732 is in contact with the button arm 62. As a result, when the push buttons 60 and 70 are assembled and held in the push button holder 54, the push buttons 60 and 70 can be moved along the Y direction, and shifting of the push buttons 60 and 70 in the direction intersecting the Y direction can be suppressed.

In this embodiment of the invention the button catches 63, 73 are shorter than the button bodies 61 and 71 in the thickness direction. As a result, compared with the button catches 63, 73 having the same dimension as the button bodies 61, 71 in the thickness direction, when the lock pin 21 is engaged by the button catches 63, 73, the combined dimension in the thickness direction of the button catches 63, 73 and the lock pin 21 is shorter. As a result, a thin clasp 1 can be achieved.

Note that the area of the opposing faces 631, 731 of the button catches 63, 73 is smaller in this configuration than in a configuration in which the button catches 63, 73 have the same dimension in the thickness direction as the button bodies 61 and 71. As a result, when the opposing faces 631, 731 are touching and force in a direction intersecting the Y direction is applied to the push buttons 60 and 70, the push buttons 60 and 70 can more easily shift in the direction intersecting the Y direction.

However, because the opposing faces 631, 731 in this embodiment are flat surfaces perpendicular to the Y direction, applying force in a direction intersecting the Y direction to the push buttons 60 and 70 when the opposing faces 631, 731 are touching can be suppressed. As a result, the push buttons 60 and 70 shifting in a direction intersecting the Y direction can be suppressed.

In this embodiment of the invention, because spring 84 is positioned closer to the face side than spring 83, the latch members 81 and 82 can be urged to a position closer to the center of the thickness direction than when spring 84 is disposed at the same height as spring 83. As a result, the latch members 81 and 82 can be urged without tilting.

Compared with a configuration in which spring 84 is disposed at the same height as spring 83, this configuration makes applying force to the push buttons 60 and 70 in a direction intersecting the Y direction easier. However, because the opposing faces 631, 731 of the button catches 63, 73 in this embodiment are flat surfaces perpendicular to the Y direction, applying force to the push buttons 60 and 70 in a direction intersecting the Y direction when the opposing faces 631, 731 are touching can be suppressed. As a result, the push buttons 60 and 70 shifting in a direction intersecting the Y direction can be suppressed.

Other Embodiments

The invention is not limited to the embodiments described above, and can be modified and improved in many ways without departing from the scope of the accompanying claims.

In the embodiments described above, the opposing faces 631, 731 of the button catches 63, 73, and the back of the button catches 63, 73, meet at a right angle, but the invention is not so limited.

For example, the back side of the mutually opposing ends of the button catches 63, 73 may be beveled.

Figure 12:
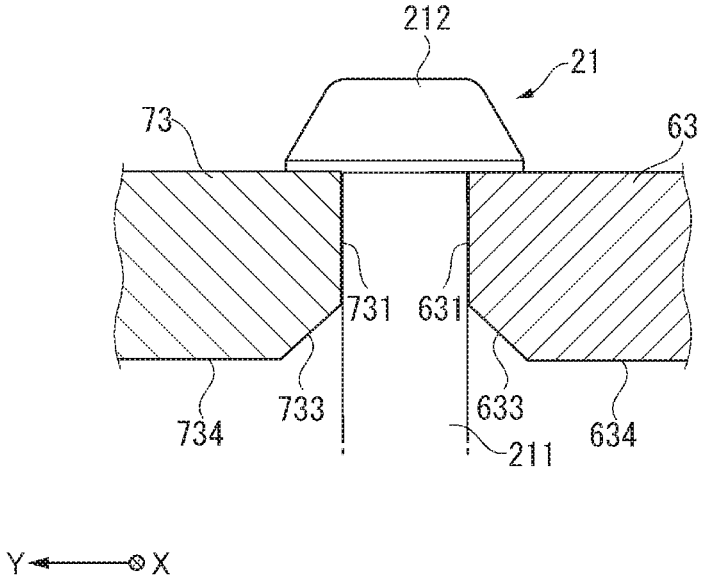
FIG. 12 is a section view showing part of a clasp according to another embodiment of the invention.

More specifically, as shown in FIG. 12, the button catches 63, 73 may be formed with beveled faces 633, 733 that continue from the outside edges on the back side of the opposing faces 631, 731, and extend away from the shank 211 of the lock pin 21 inserted to the insertion hole 541A to the bottom sides 634, 734 of the button catches 63, 73. Note that the beveled faces 633, 733 may also be curved surfaces that curve in an arc.

Compared with a configuration in which the button catches 63, 73 are not beveled, this configuration can more easily guide the lock pin 21 inserted to the insertion hole 541A to the opposing faces 631, 731, and more easily engage the face sides of the button catches 63, 73. As a result, putting on the wristwatch 100 on the user's wrist and taking the wristwatch 100 off is easier.

In this embodiment of the invention the latch members 81 and 82 are separate from the push buttons 60 and 70, but may be formed in unison with the push buttons 60 and 70. In this case, the spring 84 can be eliminated.

Furthermore, in this embodiment of the invention the spring 84 is disposed closer to the face side than the spring 83, but the invention is not so limited. For example, spring 84 and spring 83 may be disposed at the same height.

In this embodiment of the invention the button catches 63, 73 are formed so that the dimension in the thickness direction is shorter than the button bodies 61 and 71, but the invention is not so limited.

For example, the button catches 63, 73 may be formed so that the dimension in the thickness direction is the same as the button bodies 61 and 71.

The clasp according to the invention is also not limited to being used with a wristwatch band, and can also be used with bracelets, necklaces, and other accessory bands.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-116230, filed Jun. 13, 2017 is expressly incorporated by reference herein.

What is claimed is:

1. A clasp connecting a first band and a second band, comprising:

an outside plate and an inside plate pivotably connected such that the inside plate folds to nest within the outside plate, the inside plate being pivotably connected to the first band and having a lock pin;

a clasp frame pivotably connected to the outside plate;

a slide plate connected to the second band, and disposed slidably in a first direction within the clasp frame, the first direction being a longitudinal direction of the clasp frame;

a first push button and a second push button engaged with the clasp frame and disposed in a second direction perpendicular to the first direction as seen from a face side, the second direction being a lateral direction of the clasp frame;

a first spring configured to urge the first and second push buttons away from each other in the second direction;

a first latch member and a second latch member configured to engage the slide plate and restrict the slide plate from sliding, and disengage the slide plate when the first and second push buttons move in the opposite direction as the urging direction of the first spring; and a push button holder configured to house the first and second push buttons, the first spring, and the first and second latch members, the push button holder having a through-hole into which the lock pin inserts and a slot through which the first and second latch members project, the first push button having a first button catch configured to engage the lock pin inserted to the through-hole, the second push button having a second button catch configured to engage the lock pin inserted to the through-hole, the first and second button catches moving closer together in the second direction when the first and second pushbuttons move in the urging direction of the first spring, and opposing faces of the first and second button catches opposite each other in the second direction being flat surfaces perpendicular to the second direction.

2. The clasp described in claim 1, wherein:

the first pushbutton has a first button body of which part protrudes from the clasp frame in the second direction, a first button arm protruding from the first button body in the opposite direction as the second direction, and the first button catch protruding from the first button arm in the first direction;

the second push button has a second button body of which part protrudes from the clasp frame in the second direction, a second button arm protruding from the second button body in the second direction, and the second button catch protruding from the second button arm in the opposite direction as the first direction, and opposing the first button catch in the second direction;

the first button catch positioned in the second direction between the second button body and the second button catch, and the first button catch contacting the second button arm; and the second button catch positioned in the second direction between the first button body and the first button catch, and the second button catch contacting the first button arm.

3. The clasp described in claim 2, wherein:

the first and second button catches are shorter than the first and second button bodies in a thickness direction from a back surface to a face surface.

4. The clasp described in claim 1, wherein:

the lock pin inserted to the through-hole passes between the opposing faces of the first and second button catches, and engages a face side of the first and second button catches; and the first and second button catches have a beveled or curved surface continuing from an outside edge on a back side of the opposing face, and extending in a direction away from the lock pin.

5. The clasp described in claim 1, further comprising:

a second spring urging the first and second latch members away from each other in the second direction;

the slide plate disposed to the face side of the first and second push buttons;

the first and second latch members protruding from the first and second push buttons to the face side; and the second spring located closer to the face side than the first spring.

6. A timepiece comprising the clasp described in claim 1.

* * * * *